US005415965A

United States Patent [19]

Tsuda et al.

[11] Patent Number: 5,415,965

[45] Date of Patent: May 16, 1995

[54] ELECTROPHOTOGRAPHIC TONER CONTAINING A VINYL RESIN AND PROCESS FOR PRODUCING SAME

[75] Inventors: Jun Tsuda, Minami-ashigara; Mitsuo Ueno; Masashi Kobayashi, both of Kawasaki, all of Japan

[73] Assignee: Fuji Xerox Co., Ltd., Tokyo, Japan

[21] Appl. No.: 917,221

[22] Filed: Jul. 23, 1992

[30] Foreign Application Priority Data

Jul. 31, 1991 [JP] Japan ..... 3-213185

[51] Int. Cl.[6] ..... G03G 9/00

[52] U.S. Cl. ..... 430/109; 430/111

[58] Field of Search ..... 430/109, 137, 111

[56] References Cited

U.S. PATENT DOCUMENTS

| | | | |
|---|---|---|---|
| 4,504,563 | 3/1985 | Tanaka et al. | 430/109 |
| 4,626,488 | 12/1986 | Inoue | 430/109 |
| 4,900,647 | 2/1990 | Hikake et al. | 430/137 |
| 5,185,405 | 2/1993 | Nishida | 525/228 |
| 5,266,434 | 11/1993 | Hirayama et al. | 430/111 |
| 5,268,248 | 12/1993 | Tanikawa et al. | 430/111 |

FOREIGN PATENT DOCUMENTS

| | | |
|---|---|---|
| 55-147639 | 11/1980 | Japan . |
| 63-49221 | 10/1988 | Japan . |

*Primary Examiner*—Marion E. McCamish
*Assistant Examiner*—Laura Weiner
*Attorney, Agent, or Firm*—Oliff & Berridge

[57] ABSTRACT

An electrophotographic toner is disclosed which comprises a colorant and a binder resin, in which the binder resin is present as a vinyl resin whose gel content ranges from 15 to 25% by weight and whose tetrahydrofuran-soluble content has a number-average molecular weight (Mn) ranging from 5,000 to 12,000, a weight-average molecular weight (Mw) ranging from $10\times10^4$ to $40\times10^4$ and a higher Mw peak in the range of from $9\times10^5$ to $18\times10^5$. The toner exhibits improved chargeability and improved powder fluidity as well as improved fixing properties and improved offset resistance. A process for producing the toner is also disclosed.

1 Claim, No Drawings

ELECTROPHOTOGRAPHIC TONER CONTAINING A VINYL RESIN AND PROCESS FOR PRODUCING SAME

FIELD OF THE INVENTION

This invention relates to an electrophotographic toner having improved development characteristics and a process for producing the same.

BACKGROUND OF THE INVENTION

A variety of proposals have hitherto been advanced on an electrophotographic toner for improving fixing properties, offset resistance, chargeability, powder fluidity, and the like. For example, in order to satisfy both fixing properties and offset resistance, it has been proposed to use, as a binder resin, a polymer blend obtained by mixing a vinyl copolymer having a gel content of from 50 to 99% by weight and a vinyl copolymer having a gel content of not more than 10% by weight as disclosed in JP-A-55-147639 (the term "JP-A" as used herein means an "unexamined published Japanese patent application"). Further, JP-B-63-49221 (the term "JP-B" as used herein means an "examined published Japanese patent application") discloses an electrophotographic toner in which a binder resin comprising a low-molecular weight polymer and an insoluble and infusible high-molecular weight polymer is used for improving fixing properties and offset resistance.

However, although the toner prepared by using two kinds of resins different in gel content or by using a combination of a low-molecular weight polymer and an insoluble and infusible high-molecular weight polymer has improved fixing properties, it fails to maintain stable chargeability and stable powder fluidity, still being unsatisfactory for practical use.

SUMMARY OF THE INVENTION

An object of the present invention is to provide an electrophotographic toner.which is prepared by using a single kind of a resin component and exhibits improved chargeability and improved powder fluidity as well as improved fixing properties and improved offset resistance.

As a result of extensive investigations, the inventors have found that the above object can be accomplished by using a resin component having a specific gel content and a specific molecular weight and thus reached the present invention.

The present invention relates to an electrophotographic toner mainly comprising a colorant and a binder resin, in which the binder resin is a vinyl resin whose gel content ranges from 15 to 25% by weight and whose tetrahydrofuran-soluble content (hereafter referred to as THF-soluble content) has a number-average molecular weight (hereinafter referred to as Mn) ranging from 5,000 to 12,000, a weight-average molecular weight (hereinafter referred to as Mw) ranging from $10\times10^4$ to $40\times10^4$ and a higher Mw peak in the range of from $9\times10^5$ to $18\times10^5$.

The electrophotographic toner of the present invention can be prepared by melt-kneading a mixture of a colorant and a vinyl resin, followed by pulverizing, and classifying, wherein the vinyl resin has a gel content of from 30 to 40% by weight and contains a THF-soluble content which has an Mn of from 1,000 to 5,000, an Mw of from $3\times10^4$ to $10\times10^4$, and an Mw to Mn ratio (Mw/Mn) of from 15 to 25 and which has a single-peak molecular weight distribution.

DETAILED DESCRIPTION OF THE INVENTION

The terminology "gel content" as used herein means a gel content as measured after allowing the resin to stand in toluene at room temperature for 24 hours. The gel in the resin is an extremely high molecular weight component not soluble in tetrahydrofuran.

The resin component which can be used as a raw material in the preparation of the toner of the present invention is a vinyl resin whose gel content ranges from 30 to 40% by weight, whose THF-soluble content has a single-peak molecular weight distribution, i.e., having one maximum peak in the molecular weight distribution curve, and has an Mn of from 1,000 to 5,000, an Mw of from $3\times10^4$ to $10\times10^4$, and an Mw/Mn ratio of from 15 to 25. Specific examples of such resins include polymers comprising as monomer component one or more of monomers selected from styrene, styrene derivatives (e.g., α-methylstyrene, p-chlorostyrene), acrylic acid, acrylic esters (e.g., methyl acrylate, ethyl acrylate, propyl acrylate, butyl acrylate, 2-ethylhexyl acrylate, dodecyl acrylate), methacrylic acid, methacrylic esters (e.g., methyl methacrylate, ethyl methacrylate, propyl methacrylate, butyl methacrylate, octyl methacrylate), acrylonitrile, methacrylonitrile, acrylamide, and so on. Additionally, copolymers of the above-mentioned styrene and/or acrylate monomers and other vinyl comohomer(s) may also be used. Examples of usable other vinyl comonomers include unsaturated olefins (e.g., ethylene, propylene, butylene, isobutylene), vinyl chloride, vinyl bromide, and vinyl esters (e.g., vinyl acetate, vinyl propionate).

Preferred of these resins are styrene polymers, styrene-acrylate polymers or acrylate polymers.

The polymers can be prepared by suspension polymerization, emulsion polymerization, bulk polymerization, solution polymerization or the like technique as described in the following preparation example.

PREPARATION EXAMPLE 85 parts by weight (hereinafter the same) of styrene, 15 parts of n-butyl methacrylate, 1 part of t-dodecylmercaptan, 0.6 part of divinylbenzene, and 2 parts of azobisisobutyronitrile were charged in a reactor to which a solution of 0.6 part of partially saponified polyvinyl alcohol in 200 parts of deionized water was further added. The mixture was stirred at 80° C. in a nitrogen atmosphere to conduct suspension polymerization. The polymerization reaction was completed in 8 hours. The reaction mixture was cooled, dehydrated, and dried to obtain a polymer. The resulting polymer had a gel content of 35% by weight, an Mn of $4.5\times10^3$, and an Mw of $8\times10^4$.

Any of common colorants may be used in the present invention. Suitable colorants include carbon black, graphite, nigrosin, azo pigments, phthalocyanine pigments, and quinacridone pigments. A part or the whole of carbon black may be replaced with a magnetic powder to obtain a magnetic toner. Examples of suitable magnetic powders include magnetite, ferrite, iron powder, and a nickel powder. The colorant is generally used in an amount of from 0.01 to 15% by weight, preferably from 0.1 to 7% by weight, based on the weight of the binder resin.

The toner of the present invention can be prepared by melt-kneading the above-mentioned colorant and resin component and pulverizing and classifying to collect fine particles having an average particle diameter of from 5 to 20 μm. The melt-kneading may be carried out by means of, for example, a ball mill, a Banbury mixer, a kneader coater, a CM mixture, or an extruder. The molten blend is cooled, pulverized in a usual manner, and classified.

Through the above-described melt-kneading and pulverization, the binder resin in the resulting toner comes to have a gel content of from 15 to 25% by weight and a THF-soluble content having an Mn of from 5,000 to 12,000, an Mw of from $10\times10^4$ to $40\times10^4$, and showing a higher Mw peak in the range of from $9\times10^5$ to $18\times10^5$.

The gel content of the binder resin present in the toner should range from 15 to 25% by weight. If it is lower than 15% by weight, the toner particles are liable to cohesion due to excessive adhesion among them and, also, fixing latitude in temperature (i.e., fixing window) becomes narrow. If it is higher than 25% by weight, on the other hand, the melting temperature of the toner increases to reduce fixing properties, causing offset (stains on the back side of copies). Besides, the colorant, fillers, charge control agents and other additives tend not to be uniformly dispersed, which leads to broadening of charge quantity distribution or selective development, resulting in a failure of obtaining satisfactory images.

It is also required that the THF-soluble content of the binder resin present in the toner should have an Mn of from 5,000 to 12,000, an Mw of from $10\times10^4$ to $40\times10^4$ and a higher Mw peak within a range of from $9\times10^5$ to $18\times10^5$. As far as the Mn and Mw fall within the above respective range, the lower limit of fixing temperature can be lowered while exhibiting satisfactory fixing properties. As far as the higher Mw peak falls within the above specific range, satisfactory offset resistance is maintained in spite of the low fixing temperature and, also, the toner exhibits prolonged durability without suffering from carrier impaction.

The electrophotographic toner according to the present invention exhibits satisfactory levels of chargeability and powder fluidity as well as fixing properties.

If desired, the toner of the present invention may further contain known additives, such as charge control agents, e.g., salicylic acid metal salts, nigrosin, and quaternary ammonium salts; and offset preventives, e.g., low-molecular propylene, low-molecular polyethylene, and waxes. It may furthermore contain external additives, such as fluidizing agents, e.g., silica, titania, and alumina; and cleaning aids or transfer aids, e.g., polystyrene fine particles, polymethyl methacrylate fine particles, and polyvinylidene fluoride fine particles.

The gel content of the starting resin component or the binder resin in the toner can be measured by immersing the resin, pressed at 150° C. and put in a 80 mesh metallic cage, in toluene for 24 hours and, after drying, measuring the weight of the insoluble matter.

The Mn and Mw can be measured by gel-permeation chromatography (GPC). In the present invention, the following GPC conditions were employed.

Chromatograph: HLC-802A (manufactured by Toso Co., Ltd.)
Detector: RI
Column: GMH×6 (manufactured by Toso Co., Ltd.)
Solvent: Tetrahydrofuran
Flow Rate: 1.0 ml/min
Sample: 0.5% Tetrahydrofuran solution
Column Temperature: 38° C.

With respect to molecular weight distribution, a molecular weight of a sample was calculated from the number of count in relation to the logarithm of a calibration curve prepared by using a plurality of mono-dispersed polystyrene standard samples. The standard polystyrene samples used here had molecular weights of $676\times10^4$, $384\times10^4$, $126\times10^4$, $70.5\times10^4$, $35.5\times10^4$, and $10.2\times10^4$, all produced by Toso Co., Ltd.

The present invention is now illustrated in greater detail with reference to Examples, but it should be understood that the present invention is not construed as being limited thereto. All the parts and percents are given by weight unless otherwise indicated.

Example 1

A hundred parts of a styrene/2-ethylhexyl acrylate/n-butyl methacrylate copolymer (molar ratio=81:14:5; Mn: $5\times10^3$; Mw: $7.5\times10^4$; Mw/Mn=15; gel content: 31%) (hereinafter referred to as polymer A), 15 parts of carbon black, and 2 parts of a monoazo chromium complex ("Aizen Spiron Black TRH" produced by Hodogaya Chemical Co., Ltd.) were melt-kneaded in a ball mill. After cooling, the mixture was crushed in a hammer mill and then pulverized in an ultrasonic jet pulverizer. The resulting fine powder was classified by means of an air classifier to collect particles having an average particle size of from 5 to 20 μm. The resulting toner contained a binder resin having an Mn of $7\times10^3$, an Mw of $12.8\times10^4$, an Mw/Mn ratio of 18.3, a higher Mw peak at $12\ 4\times10^5$ and a gel content of 16%.

The toner was subjected to a fixing test. As a result, the permissible lowest fixing temperature was 165° C. No offset phenomenon was observed even at a fixing temperature of 230° C. The charge quantity as measured by Toshiba Blow-Tribo System was 12.8° C./g, giving a clear image having a solid density of 1.42 as measured with a Macbeth. densitometer. Further, the toner exhibited excellent powder fluidity, having an apparent density of 0.37 (JIS) and a cohesiveness of 14.2% (JIS). These powder fluidity characteristics are far above the conventional standard levels, i.e., an apparent density of 0.34 and a cohesiveness of 76.9%.

Example 2

A hundred parts of a styrene/2-ethylhexyl acrylate/n-butyl methacrylate copolymer (molar ratio=81:14:5; Mn: $4\times10^3$; Mw: $10\times10^4$; Mw/Mn=25; gel content: 39%) (hereinafter referred to as polymer B), 15 parts of carbon black, and 2 parts of a monoazo chromium complex "Aizen Spiron Black TRH" were melt-kneaded, pulverized, and classified in the same manner as in Example 1 to obtain a toner. The resulting toner contained a binder resin having an Mn of $12\times10^3$, an Mw of $23.9\times10^4$, a higher Mw peak at $12.6\times10^6$ and a gel content of 24%

The toner was tested in the same manner as in Example 1. As a result, the permissible lowest fixing temperature was 165° C. No offset phenomenon was observed even at a fixing temperature of 240° C. The charge quantity as measured by Toshiba Blow-Tribo System was 13.4° C./g, giving a clear image having a solid density of 1.45 as measured with a Macbeth densitometer. Further, the toner exhibited greatly improved powder fluidity, having an apparent density of 0.38 and a cohesiveness of 15.5%, over the conventional toners.

Comparative Example 1

A toner was prepared in the same manner as in Example 1, except for replacing polymer A with a styrene/2-ethylhexyl acrylate/n-butyl methacrylate copolymer (molar ratio=81:14:5; Mn: $2\times10^4$; Mw: $44.2\times10^4$; Mw/Mn=17.0; gel content: 0%) (hereinafter referred to as polymer C).

The binder resin in the resulting toner had an Mn of $1.3\times10^4$, an Mw of $26.6\times10^4$, and a higher Mw peak at $40.3\times10^4$.

The resulting toner was evaluated in the same manner as in Example 1.

Comparative Example 2

A toner was prepared in the same manner as in Example 1, except for replacing polymer A with a styrene/2-ethylhexyl acrylate/n-butyl methacrylate copolymer (molar ratio=81:14:5; Mn: $8\times10^3$; Mw: $27.1\times10^4$; Mw/Mn=33.9; gel content: 15%) (hereinafter referred to as polymer D).

The binder resin in the resulting toner had an Mn of $1.3\times10^4$, an Mw of $16.6\times10^4$, a higher Mw peak at $72.5\times10^4$, and a gel content of 8%.

The resulting toner was evaluated in the same manner as in Example 1.

Comparative Example 3

A toner was prepared in the same manner as in Example 1, except for replacing polymer A with a styrene/2-ethylhexyl acrylate/n-butyl methacrylate copolymer (molar ratio=81:14:5; Mn: $1.7\times10^3$; Mw: $48\times10^4$; Mw/Mn=29.1; gel content: 45%) (hereinafter referred to as polymer E).

The binder resin in the resulting toner had an Mn of $6\times10^4$, an Mw of $9.8\times10^4$, a higher Mw peak at $13.4\times10^5$, and a gel content of 25%.

The resulting toner was evaluated in the same manner as in Example 1.

Comparative Example 4

A toner was prepared in the same manner as in Example 1, except for using a copolymer having two-peak molecular weight distribution as a raw material in place of polymer A. The binder resin in the toner had an Mn of $11\times10^4$, an Mw of $28.3\times10^4$, and a higher Mw peak at $85.4\times10^4$.

The resulting toner was evaluated in the same manner as in Example 1.

The results of evaluation in Examples 1 and 2 and Comparative Examples 1 to 4 are shown in Table 1 below.

TABLE 1

| | Compara. Ex. 1 | Compara. Ex. 2 | Ex. 1 | Ex. 2 | Compara. Ex. 3 | Compara. Ex. 4 |
|---|---|---|---|---|---|---|
| Gel Content (%) | 0 | 15 | 31 | 39 | 45 | — |
| Fixing Properties: | | | | | | |
| Melting Point (°C.) | 135 | 155 | 165 | 165 | 180 | 135 |
| Hot Offset Temp. (°C.) | 180 | 195 | 240 | 245 | 240 | 190 |
| Fixing Window (°C.) | 45 | 40 | 75 | 80 | 60 | 55 |
| Chargeability: | | | | | | |
| Quantity of Triboelectricity (μC/g) | 19.0 | 17.2 | 12.8 | 13.4 | 12.5 | 19.4 |
| Powder Fluidity: | | | | | | |
| Apparent Density (g/cc) | 0.32 | 0.34 | 0.37 | 0.38 | 0.36 | 0.33 |
| Cohesiveness (wt %) | 82.0 | 69.3 | 14.2 | 15.5 | 14.3 | 76.9 |

As can be seen from the results in Table 1, a toner having a broad fixing window can be obtained without using a previously prepared combined binder resin system composed of a low-molecular weight component and a high-molecular weight component. It is also seen that, by controlling the gel content of the binder resin within a specific range, the compatibility among the low-molecular weight component, the high-molecular weight component, and the gel content is changed in such a way as to improve dispersibility of the colorant, the charge control agent, etc. in the binder resin thereby to improve triboelectric chargeability. The gel content control also brings about improvements in powder fluidity characteristics, such as apparent density and cohesiveness.

As described above, use of the single resin component having a controlled gel content and a controlled molecular weight makes it possible to prepare an electrophotographic toner exhibiting excellent chargeability and fluidity as well as excellent fixing properties. The resulting toner is excellent in fixing latitude, fluidity, and chargeability, thus producing satisfactory fixed images for an extended duration.

While the invention has been described in detail and with reference to specific examples thereof, it will be apparent to one skilled in the art that various changes and modifications can be made therein without departing from the spirit and scope thereof.

What is claimed is:

1. An electrophotographic toner comprising a colorant and a binder resin, wherein said binder resin is a vinyl resin whose gel content ranges from 15 to 25% by weight and whose tetrahydrofuran-soluble content has a number-average molecular weight ranging from 5,000 to 12,000 and a weight-average molecular weight ranging from $10\times10^4$ to $40\times10^4$ and wherein said binder resin has a first and a second peak in its molecular weight distribution in the range of from $9\times10^5$ to $18\times10^5$ to $18\times10^5$ and from $3\times10^4$ to $10\times10^4$, respectively, in terms of weight-average molecular weight.

* * * * *